US005097231A

United States Patent [19]

Johnson et al.

[11] Patent Number: 5,097,231

[45] Date of Patent: Mar. 17, 1992

[54] QUASI-PASSIVE, NON-RADIOACTIVE RECEIVER PROTECTOR DEVICE

[75] Inventors: Arvid C. Johnson, Newburyport; Thomas J. Pappalardo, South Hamilton, both of Mass.

[73] Assignee: Varian Associates, Inc., Palo Alto, Calif.

[21] Appl. No.: 525,160

[22] Filed: May 16, 1990

[51] Int. Cl.[5] ..... H01P 1/14

[52] U.S. Cl. ..... 333/13; 313/309; 313/601

[58] Field of Search ..... 333/13; 313/309, 336, 313/351, 601

[56] References Cited

U.S. PATENT DOCUMENTS

| | | | |
|---|---|---|---|
| 3,453,478 | 7/1969 | Shoulders et al. | 313/309 |
| 3,644,779 | 2/1972 | Goldie | 333/13 |
| 3,665,241 | 5/1972 | Spindt et al. | 313/351 |
| 3,710,178 | 1/1973 | Johnson et al. | 313/601 X |
| 3,755,704 | 8/1973 | Spindt et al. | 313/309 |
| 3,858,125 | 12/1974 | Nelson et al. | 333/13 |
| 4,780,684 | 10/1988 | Kosmahl | 330/54 |

OTHER PUBLICATIONS

C. A. Spindt et al., Applications of Surface Science, vol. 16, 1983, pp. 268–276.

"Product and Engineering Data", Varian Associates, 1989, pp. 29–47.

"The Chip That Adores a Vacuum", The Economist, Aug. 12, 1989, pp. 69–72.

*Primary Examiner*—Paul Gensler

*Attorney, Agent, or Firm*—Peter J. Sgarbossa

[57] ABSTRACT

A receiver protector device includes a sealed discharge chamber containing one or more pairs of spaced-apart, conical electrodes and an ionizable gas. A field emission array is mounted in the discharge chamber to provide a source of free electrons which assist in initiating a discharge when an RF input signal exceeds a desired threshold power level. The field emission array includes a substrate, a plurality of generally conical emitters distributed on the substrate, a conductive gate layer for extracting electrons from the emitters and a dielectric layer between the gate layer and the substrate. When a bias voltage is applied to the gate layer, electrons are extracted from the emitters. The field emission array can be mounted adjacent to the electrodes or in a recess in one of the electrodes. The bias voltage can be supplied by a battery mounted on the receiver protector device external to the discharge chamber.

28 Claims, 3 Drawing Sheets

QUASI-PASSIVE, NON-RADIOACTIVE RECEIVER PROTECTOR DEVICE

FIELD OF THE INVENTION

This invention relates to devices for protecting radio frequency receivers against high levels of RF input power and, more particularly, to receiver protector devices which utilize a field emission array as a source of free electrons, thereby eliminating radioactive materials and permitting operation from a battery.

BACKGROUND OF THE INVENTION

It is customary in microwave and radio frequency (RF) systems which include both a transmitter and a receiver to use a common antenna for transmitting and receiving. An example of such a system is a radar system. In order to protect the highly-sensitive front end of the receiver during transmission at high power levels, receiver protector devices are utilized.

Receiver protector devices typically include a sealed section of waveguide having an input port and an output port. The sealed waveguide section encloses a discharge chamber. One or more pairs of electrodes are positioned in the discharge chamber with a predetermined spacing. The electrodes have pointed tips to increase the electric field gradient between them. The discharge chamber includes an ionizable gas. When RF input power at or above a predetermined threshold level is received at the input port, the gas in the discharge chamber is ionized, thereby short circuiting the input signal. As a result, little or nor RF power reaches the output port of the receiver protector device. When the RF input power level is below the threshold required for ionization, the input signal passes essentially unattenuated to the output port.

A source of free electrons is required in the discharge chamber to assist initiating a discharge at a desired level of RF input power. One prior art technique for providing free electrons involves the use of a radioactively-primed "keep-alive" filament in the discharge chamber. A current is supplied to the filament at all times so that a supply of free electrons is always available. While receiver protector devices utilizing filaments provide generally satisfactory performance, the filament draws a significant current from the system power supply. Furthermore, the filament is usually the life-limiting element of the receiver protector device.

In order to eliminate the problems associated with keep-alive filaments, radioactive isotopes such as tritium, cobalt, etc. have been utilized in receiver protector devices as a source of free electrons. While radioactive isotopes eliminate the requirement for a filament and a filament power supply and extend the life of the receiver protector device, they present problems during assembly, repair and scrap of the receiver protector devices due to the hazards associated with radioactive materials. Furthermore, it is becoming increasingly difficult to dispose of the radioactive materials which remain in the receiver protector device at the end of their useful lives. Since the amount of radioactive material that can be utilized is limited due to safety considerations, the number of free electrons supplied is greatly reduced from the keep alive configuration. Solid state limiters are required after the receiver protectors with radioactive isotopes to protect against higher firing levels of RF input power. However, this increases the complexity and cost of the receiver protector device.

It is a general object of the present invention to provide improved receiver protector devices.

It is another object of the present invention to provide a novel source of free electrons in a receiver protector device.

It is a further object of the present invention to provide a discharge device which utilizes a field emission array as a source of free electrons.

It is yet another object of the present invention to provide receiver protector devices which do not utilize radioactive materials.

It is still another object of the present invention to provide receiver protector devices which draw little or no electrical power from the system in which they are installed.

It is another object of the present invention to provide receiver protector devices which are simple in construction and low in cost.

It is a further object of the present invention to provide receiver protector devices which have a long operating life.

SUMMARY OF THE INVENTION

According to the present invention, these and other objects and advantages are achieved in a discharge device which includes a field emission array for emitting free electrons to assist in initiating a discharge. The discharge device is typically a receiver protector device, but is not limited to such use.

A receiver protector device in accordance with the invention comprises a sealed discharge chamber having an input port for receiving an RF input signal and an output port for coupling to a receiver, an ionizable gas in the discharge chamber, at least one pair of spaced-apart electrodes in the discharge chamber, a field emission array mounted in the discharge chamber, and means for biasing the field emission array such that when the RF input signal exceeds a predetermined level, the field emission array provides sufficient free electrons between the electrodes to ionize the gas and form a discharge between the electrodes, whereby the RF input signal is effectively short circuited.

The field emission array comprises a substrate such as silicon, a plurality of emitters distributed on the substrate, a conductive gate layer for extracting electrons from the emitters and a dielectric layer between the gate layer and the substrate. The emitters are typically conical in shape. When a bias voltage is applied to the gate layer, electrons are extracted from the emitters via field emission.

In a typical configuration, the discharge chamber comprises a section of waveguide, and each of the electrodes includes a sharp tip to increase the electric field gradient between electrodes. In one configuration, the field emission array is mounted adjacent to the spaced apart electrodes and directs free electrons into the space between electrodes. In another configuration, the field emission array is mounted in a recess in one of the electrodes and directs free electrons into the space between electrodes.

The biasing means comprises means for connecting a bias voltage between the gate layer and the substrate of the field emission array. In a preferred embodiment, the biasing means comprises a battery mounted on the receiver protector device external to the discharge chamber. In another embodiment, the biasing means comprises means for connecting the field emission array to a system power source.

In one configuration, the biasing means causes the field emission array to emit free electrons continuously. In another configuration, the biasing means includes a bias source for biasing the field emission array below a level required for continuous emission of free electrons in the absence of an RF signal. The biasing means further includes means for coupling the RF input signal to the field emission array such that the bias source and the RF input signal together cause emission of sufficient free electrons to ionize the gas in the discharge chamber.

BRIEF DESCRIPTION OF THE DRAWINGS

For a better understanding of the present invention, together with other and further objects, advantages and capabilities thereof, reference is made to the accompanying drawings which are incorporated herein by reference and in which.

DETAILED DESCRIPTION OF THE INVENTION

Figure 1:
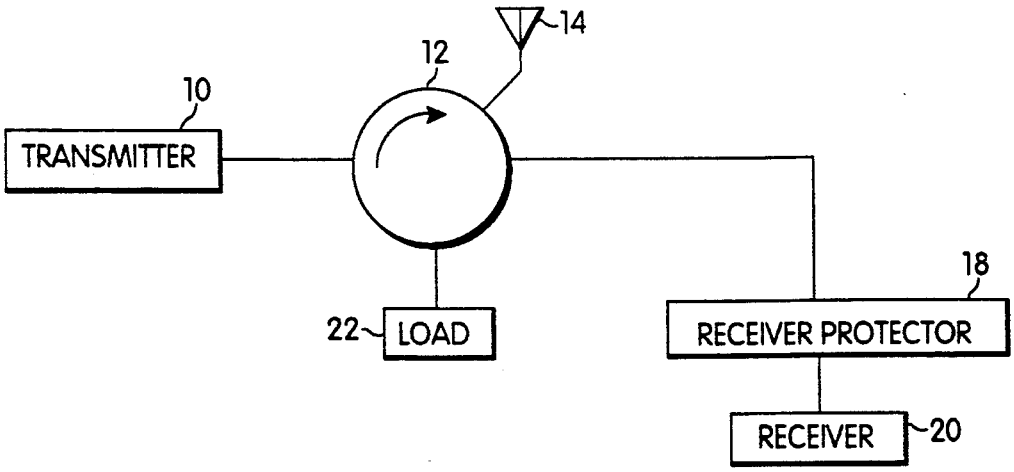
FIG. 1 is a block diagram of a system which incorporates a receiver protector device.

A simplified block diagram of a system that utilizes a receiver protector device is shown in FIG. 1. A transmitter 10 is connected to a first port of a circulator 12. A second port of the circulator 12 is connected to an antenna 14. A receiver protector device 18 has an input port connected to a third port of the circulator 12 and an output port connected to a receiver 20. A load 22 is connected to a fourth port of the circulator 12. The connections between the elements are typically by waveguide for operation at microwave frequencies. An example of such a system is a radar system.

High power RF pulses ar generated by transmitter 10 and are transmitted through antenna 14. Low power reflected RF pulses are received by antenna 14 and are carried to receiver 20. The receiver 20 is highly sensitive and is subject to damage by RF signals above a predetermined power level. The receiver protector device 18 protects the input of receiver 20 by short-circuiting RF input signals above the predetermined power level. A typical threshold power level for firing of the receiver protector device is on the order of about 100 milliwatts.

Figure 2:
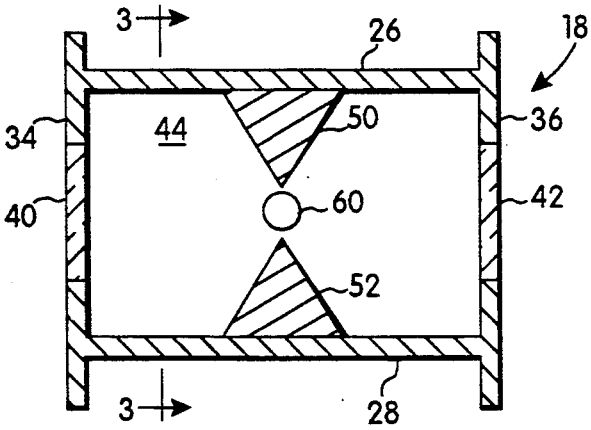
FIG. 2 is a cross-sectional view of a receiver protector device in accordance with the invention.
Figure 3:
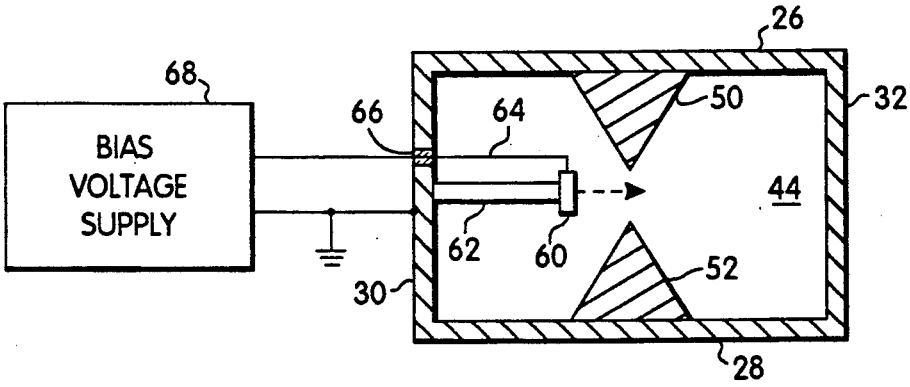
FIG. 3 is a cross-sectional view of the receiver protector device taken along the line 3—3 of FIG. 2.

A receiver protector device in accordance with the present invention is shown in FIGS. 2 and 3. A section of rectangular waveguide forms a housing, or enclosure, including a top wall 26, a bottom wall 28, sidewalls 30 and 32 and end walls 34 and 36, all of a conductive metal such as aluminum. The end walls 34 and 36 are in the form of waveguide flanges for connection to input and output waveguides, respectively. Flanges 34 and 36 include windows 40 and 42, respectively, which seal the device to provide a vacuum tight discharge chamber 44 while permitting passage of RF power. The window 40 is the input port, and the window 44 is the output port of the receiver protector device 18.

The discharge chamber 44 contains an ionizable gas at a pressure level in a range of about 0.001 to 100 torr. Typical gases include argon, ammonia, water vapor, xenon and combinations thereof at a pressure on the order of about 1 torr. An electrode 50 is mounted in discharge chamber 44 and is attached to top wall 26. An electrode 52 is mounted in discharge chamber 44 and is attached to bottom wall 28. The electrodes 50 and 52 are typically conical in shape and are fabricated of copper or another conductor. The electrodes 50 and 52 are aligned with each other and are separated by a predetermined spacing which depends on the desired RF threshold level and the voltage at which ionization of the gas in discharge chamber 44 occurs. The electrodes 50 an 52 preferably include sharp tips to increase the electric field gradient in the region between them.. However, electrodes of any suitable shape can be utilized without departing from the scope of the present invention.

In accordance with the present invention, a field emission array 60 is mounted in the discharge chamber 44 to provide a source of free electrons which assist in initiating a discharge when the RF input signal exceeds a desired threshold power level. In the embodiment of FIGS. 2 and 3, the field emission array 60 is mounted on a support pedestal 62 attached to sidewall 30. The support pedestal 62 positions the field emission array 60 adjacent to a region between electrodes 50 and 52 so that free electrons are supplied between electrodes 50 and 52. The support pedestal 62 is preferably a conductor for grounding the substrate of the field emission array 60 as described hereinafter. The field emission array 60 is connected by an electrical lead 64 through a vacuum feedthrough 66 to one terminal of a bias voltage supply 68. The other terminal of the bias voltage supply 68 is electrically connected to the conductive housing of the receiver protector device 18.

Figure 4:
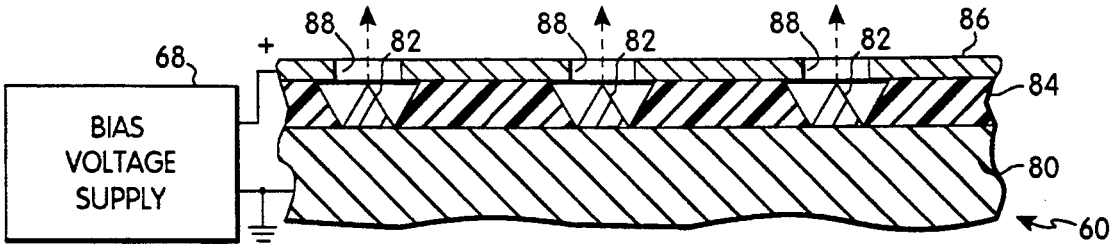
FIG. 4 is an enlarged, partial cross-sectional view of a field emission array.

An enlarged, partial cross-sectional view of the field emission array 60 is shown in FIG. 4. A substrate 80 can be a semiconductor, such as silicon, or a conductor, such as titanium. A plurality of emitters 82 are distributed on the substrate 80. The emitters 82 are typically tungsten, molybdenum or silicon and have a generally conical shape with a uniform or nonuniform taper to a tip. A dielectric layer 84, such as silicon dioxide, is formed on the substrate 80 in areas surrounding the emitters 82. A conductive gate layer 86 of a material such as copper is formed over dielectric layer 84. The gate layer 86 is fabricated with circular apertures 88 (FIG. 5) respectively aligned with each of the emitters 82. The dielectric layer 84 typically has a thickness that is approximately equal to the height of the emitters 82 so that the tips of emitters 82 are approximately in the plane of gate layer 86. The tips of emitters 82 are approximately centered in circular apertures 88.

By way of example, the emitters 82 can have a base diameter on the order of 1 micrometer, the dielectric layer 84 can have a thickness on the order of 1 micrometer, and the gate layer 86 can have a thickness on the order of 0.2–0.5 micrometer. The emitters 82 are typically separated by dimensions on the order of about 5 micrometers. Further details regarding field emission arrays are provided by C. A. Spindt et al in "Field Emission Cathode Array Development for High-Current-Density Applications", *Applications of Surface Science,* Vol. 16, 1983, pages 268–276, which is hereby incorporated by reference. Field emission arrays are also disclosed in U.S. Pat. Nos. 3,453,478 issued July 1, 1969, 3,665,241 issued May 23, 1972 and 3,755,704 issued Aug. 28, 1973.

Figure 5:
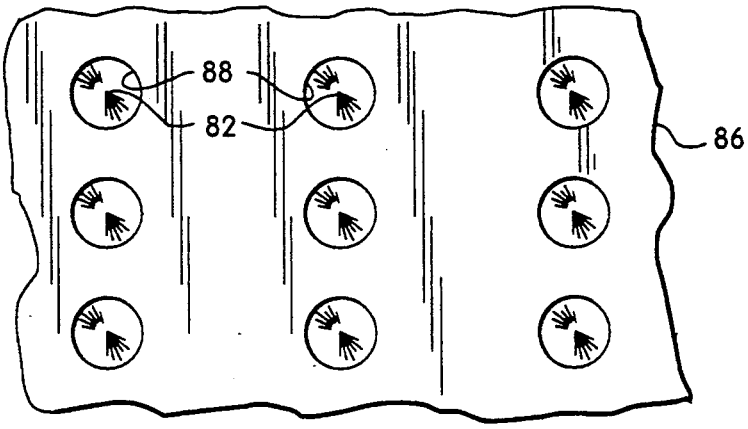
FIG. 5 is an enlarged, partial plan view of a field emission array.

In operation, the bias voltage supply is connected between gate layer 86 and substrate 80. When a positive voltage is applied to gate layer 86, electrons are emitted from each of the emitters 82. Currents of 50 microamps per emitter 82 over an operating life of greater than 50,000 hours are considered achievable. The field emission array 60 can include any desired number of emitters 82 on substrate 80 in an X Y array as shown in FIG. 5. The number of emitters depends on the required current level and the desired operating current per emitter. The typical free electron current required for receiver protector devices is in a range of about 0.01 to 200 microamps. The overall dimensions of the field emission array are typically on the order of about 2 mm×2 mm.

According to one preferred bias technique, the field emission array 60 is biased with a voltage from supply 68 of sufficient magnitude to emit free electrons continuously. A typical bias voltage is in the range of about 10 to 100 volts. The bias voltage can be AC or DC. When an AC bias voltage is used, free electrons are emitted during only one half of the AC voltage cycle.

According to another preferred bias technique, the field emission array 60 is biased with a voltage from supply 68 that is somewhat less than the voltage required for emission of a significant free electron current. When an RF input signal is received through the input port of the receiver protector device, a portion of the RF signal is coupled to the field emission array 60 and, together with the applied bias voltage from supply 68, causes emission of free electrons which assist in ionizing gas between electrodes 50 and 52. The field emission array 60 in this configuration functions as a microstrip transmission line having emitters 82 spaced along it, and the RF field within the receiver protector device is capacitively coupled to the field emission array. According to this technique, the sum of the voltage from supply 68 and the CF input signal is sufficient to bias the field emission array into free electron emission. This operating configuration is possible because of the extremely fast response time of the field emission array, on the order of about one picosecond. The advantages of such a configuration are that very little current is drawn from the bias voltage supply 68, and electrons are emitted only when an CF signal is received. Therefore, continuous electron bombardment of the surfaces within the receiver protector device is avoided.

A significant advantage of the present invention is that the field emission array draws significantly less power than prior art keep-alive filaments. Typical keep-alive filaments draw currents on the order of 100 microamps at 400 volts, whereas a typical field emission array draws a current on the order of 100 microamps at 40 volts. Since the power required by the field emission array 60 is small, it is conveniently powered by a battery mounted external to the discharge chamber 44. For example, a battery for biasing the field emission array 60 can be mounted on one of the external surfaces on the receiver protector device 18. In this configuration, no current is drawn from the system in which the receiver protector device is installed. Alternatively, the bias voltage for the field emission array 60 can be provided by the system power supply.

Figure 6:
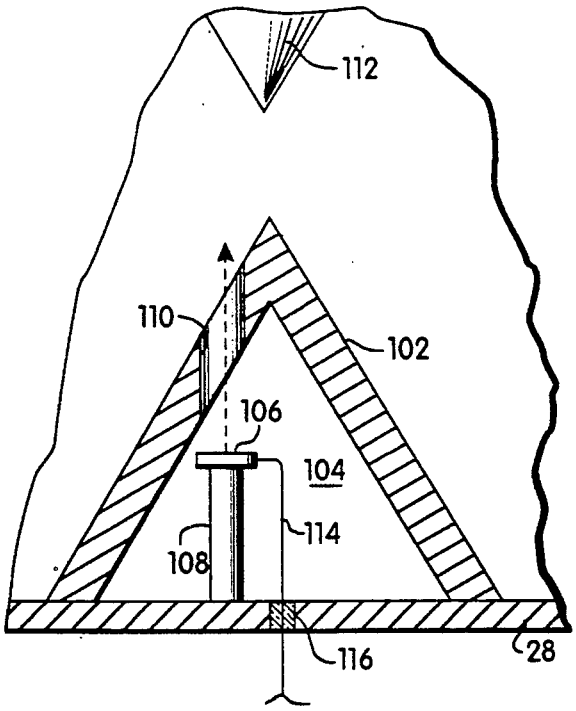
FIG. 6 is an enlarged cross-sectional view of an electrode for a receiver protector device in accordance with an alternate embodiment of the invention.

Another preferred embodiment of the invention is illustrated in FIG. 6, which shows an enlarged cross-sectional view of an electrode 102. The electrode 102 corresponds generally to electrode 52 shown in FIGS. 2 and 3. An electrode 112, which corresponds generally to electrode 50 shown in FIG. 2, is spaced from electrode 102 in a discharge chamber that is similar to discharge chamber 44 shown and described above. The electrode 102 is mounted on the bottom wall 28 of the receiver protector device and has a generally conical shape with a hollow interior 104. A field emission array 106 is mounted within the hollow interior 104. The field emission array 106 can be mounted on a support pedestal 108, if necessary for proper positioning. The electrode 102 includes an opening 110 which permits free electrons generated by field emission array 106 to be directed into the region between electrode 102 and electrode 112. The field emission array 106 is connected by an electrical lead 114 through a vacuum feedthrough 116 to a bias voltage supply as shown in FIG. 4.

It will be understood that the configuration including electrode 102 with hollow interior 104 and opening 110 can be varied within the scope of the present invention. For example, the field emission array 106 can be mounted in a recess in the surface of electrode 102. It will further be understood that the field emission array can be mounted in any desired location within the discharge chamber. 44. The parameters of the field emission array are selected to provide sufficient free electrons in the space between the electrodes to cause ionization at the desired RF input power level.

The present invention has been described hereinabove in connection with a receiver protector device wherein a field emission array provides free electrons to assist in initiating a discharge when an RF input signal exceeds a predetermined threshold level. However, the present invention is not limited to receiver protector devices. A field emission array can be utilized in any discharge device which requires a supply of free electrons to assist in initiating a discharge. The elements of such a discharge device include a sealed discharge chamber containing an ionizable gas, at least one pair of spaced-apart electrodes in the discharge chamber, means for coupling a voltage to the electrodes, a field emission array mounted in the discharge chamber and means for biasing the field emission array such that when the voltage between the electrodes exceeds a predetermined level, the field emission array provides sufficient free electrons between the electrodes to ionize the gas and form a discharge.

Figure 7:
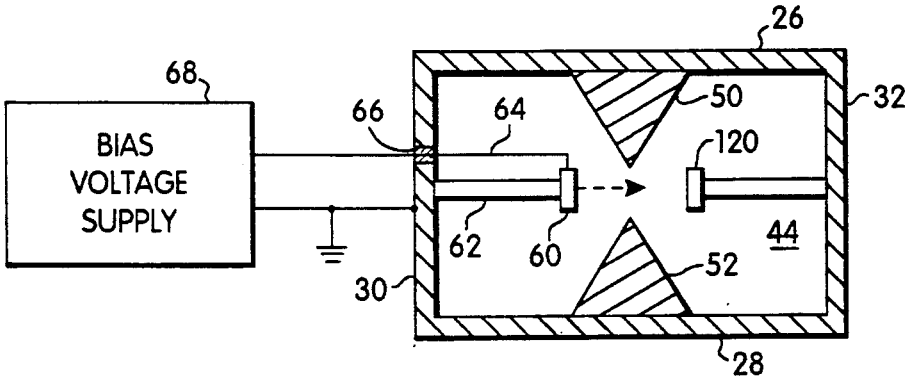
FIG. 7 is a cross-sectional view of a receiver protector device wherein an anode is used with a field emission array.

According to the embodiment of the invention shown in FIGS. 2 and 3 and described hereinabove, the field emission array 60 is utilized without an anode for collecting electrons. According to a further feature of the invention shown in FIG. 7, an anode 120 is positioned in the discharge chamber 44 on the opposite side of the space between electrodes 50 and 52 from the field emission array 60 for collecting free electrons emitted by the field emission array 60. The anode limits bombardment of surfaces within the receiver protector device by free electrons.

The electrodes in a receiver protector device are frequently elements of a bandpass filter. The bandpass filter has a passband containing the range of frequencies to be received by receiver 20. Thus, the receiver protector device is required to operate only within the passband ,of the filter. Instead of firing the receiver protector device by initiating a discharge, frequencies outside the passband of the filter are reflected by the receiver protector device and do not reach the receiver 20. The receiver protector device of the present invention, which utilizes a field emission array for supplying free electrons, can employ a bandpass filter configuration as known in the prior art.

The receiver protector device or other discharge device of the present invention provides a number of advantages in comparison with prior art devices. Radioactive materials are not required, thereby eliminating the hazards associated with the use of radioactive materials. Any desired threshold for firing of the receiver protector device can be achieved by appropriate adjustment of the emitter current level and number of elements in the field emission array. Thus, solid state limiters may not be required. Since the field emission array draws very low power, it is in effect quasi-passive. When a battery is utilized for biasing the field emission array, the receiver protector device appears to the system in which it is installed as a passive device. The receiver protector device of the present invention has a long operating life since it does not require a keep-alive filament.

While there have been shown and described what are at present considered the preferred embodiments of the present invention, it will be obvious to those skilled in the art that various changes and modifications may be made therein without departing from the scope of the invention as defined by the appended claims.

What is claimed is:

1. A receiver protector device comprising:

a sealed discharge chamber having an input port for received an RF input signal and an output port for coupling to a receiver;

an ionizable gas in said discharge chamber;

at least one pair of spaced apart electrodes in said discharge chamber;

a field emission array mounted in said discharge chamber for emitting free electrons; and means for biasing said field emission array such that when said RF input signal exceeds a predetermined level, said field emission array provides sufficient free electrons between said electrodes to ionize said gas and form a discharge between said electrodes, whereby said RF input signal is effectively short circuited.

2. A receiver protector device as defined in claim 1 wherein said field emission array comprises a substrate, a plurality of emitters distributed on said substrate, a conductive gate layer for extracting electrons from said emitters and a dielectric layer between said gate layer and said substrate.

3. A receiver protector device as defined in claim 2 wherein each of said emitters is tapered to a pointed tip.

4. A receiver protector device as defined in claim 3 wherein each of said emitters is generally conical in shape.

5. A receiver protector device as defined in claim 1 wherein each of said electrodes includes a sharp tip to provide a high electric field gradient between said electrodes.

6. A receiver protector device as defined in claim 5 wherein said discharge chamber comprises a section of waveguide.

7. A receiver protector device as defined in claim 1 wherein said field emission array is mounted adjacent to said at least one pair of spaced apart electrodes.

8. A receiver protector device as defined in claim 1 wherein said field emission array is attached to a support pedestal mounted to a wall of said discharge chamber.

9. A receiver protector device as defined in claim 1 wherein said field emission array is mounted in a recess in one of said electrodes.

10. A receiver protector device as defined in claim 1 wherein said biasing means comprises a battery mounted on said device external to said discharge chamber.

11. A receiver protector device as defined in claim 1 wherein said biasing means comprises means for connecting said field emission array to an external power source.

12. A receiver protector device as defined in claim 2 wherein said biasing means comprises means for connecting a bias voltage between said gate layer and said substrate of said field emission array.

13. A receiver protector device as defined in claim 12 wherein said bias voltage comprises a DC voltage.

14. A receiver protector device as defined in claim 12 wherein said bias voltage comprises an AC voltage.

15. A receiver protector device as defined in claim 1 wherein said biasing means causes said field emission array to emit free electrons continuously.

16. A receiver protector device as defined in claim 1 wherein said biasing means includes a bias source for biasing said field emission array below a level required for continuous emission of free electrons in the absence of an RF input signal and wherein said biasing means further includes means for coupling said RF input signal to said field emission array such that said bias source and said RF input signal together cause emission of sufficient free electrons to ionize said gas.

17. A receiver protector device as defined in claim 16 wherein said field emission array is configured as a transmission line for conducting said RF input signal.

18. A receiver protector device as defined in claim 1 further including an anode for collecting free electrons emitted by said field emission array.

19. A receiver protector device as defined in claim 1 wherein said discharge chamber has a pressure level in the range of about 0.001 torr to 100 torr.

20. A receiver protector device as defined in claim 19 wherein said ionizable gas is selected from a group consisting of argon, ammonia, water vapor, xenon and combinations thereof.

21. A receiver protector device as defined in claim 1 wherein said field emission array provides a free electron current level in the range of about 0.01 microamp to 200 microamps.

22. A receiver protector device as defined in claim 1 wherein said discharge chamber comprises a section of rectangular waveguide having top and bottom walls and sidewalls, said electrodes extending from said top and bottom walls, respectively.

23. A discharge device comprising:

a sealed discharge chamber containing an ionizable gas;

at least one pair of spaced apart electrodes mounted in said discharge chamber and means for coupling a voltage to said electrodes;

a field emission array mounted in said discharge chamber; and means for biasing said field emission array such that when said voltage exceeds a predetermined level, said field emission array provides sufficient free electrons between said electrodes to ionize said gas and form a discharge between said electrodes.

24. A discharge device as defined in claim 23 wherein said field emission array comprises a substrate, a plurality of emitters distributed on said substrate, a gate layer for extracting electrons from said emitters and a dielectric layer between said gate layer and said substrate.

25. A discharge device as defined in claim 24 wherein each of said emitters comprises a generally conical conductor.

26. A discharge device as defined in claim 23 wherein said field emission array is mounted adjacent to said at least one pair of spaced-apart electrodes.

27. A discharge device as defined in claim 24 wherein said biasing means comprises means for connecting a bias voltage between said gate layer and said substrate of said field emission array.

28. A receiver protector device comprising:

a sealed discharge chamber comprising a section of rectangular waveguide having an input port for receiving an RF input signal and an output port for coupling to a receiver, said discharge chamber containing an ionizable gas;

at least one pair of spaced apart, generally conical electrodes mounted in said discharge chamber and electrically connected to opposite walls of said rectangular waveguide;

a field emission array mounted in said discharge chamber; and means for biasing said field emission array such that when said RF input signal exceeds a predetermined power level, said field emission array provides sufficient free electrons between said electrodes to ionize said gas and form a discharge between said electrodes.

* * * * *